US008740347B2

(12) United States Patent
Tanabe

(10) Patent No.: US 8,740,347 B2
(45) Date of Patent: Jun. 3, 2014

(54) LIQUID DISCHARGE APPARATUS

(71) Applicant: Brother Kogyo Kabushiki Kaisha, Nagoya (JP)

(72) Inventor: Yuma Tanabe, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/691,496

(22) Filed: Nov. 30, 2012

(65) Prior Publication Data

US 2013/0135387 A1 May 30, 2013

(30) Foreign Application Priority Data

Nov. 30, 2011 (JP) ..... 2011-262874

(51) Int. Cl.
*B41J 2/165* (2006.01)

(52) U.S. Cl.
USPC ..... 347/33

(58) Field of Classification Search
USPC ..... 347/33
See application file for complete search history.

(56) References Cited

FOREIGN PATENT DOCUMENTS

| | | | | |
|---|---|---|---|---|
| JP | 2001-018402 | * | 1/2001 | ..... B41J 2/165 |
| JP | 2001-018406 A | | 1/2001 | |
| JP | 2009-101594 A | | 5/2009 | |

* cited by examiner

*Primary Examiner* — Alessandro Amari
*Assistant Examiner* — Michael Konczal
(74) *Attorney, Agent, or Firm* — Merchant & Gould P.C.

(57) ABSTRACT

There is provided a liquid discharge apparatus including a head including a nozzle surface having a plurality of liquid discharge holes formed thereon, the nozzle surface being directed downward, a liquid receiving part including a liquid receiving surface directed downward to oppose the nozzle surface and configured to receive liquid discharged from the liquid discharge holes, a base, a first blade attached to the base with a tip end thereof being directed upward to wipe the nozzle surface, a second blade attached to the base with a tip end thereof being directed downward to wipe the liquid receiving surface, and a moving mechanism configured to move the base in a predetermined advancing direction between the head and the liquid receiving part. The base is provided with a prevention structure configured to prevent the liquid wiped off by the first blade flowing to the second blade.

15 Claims, 7 Drawing Sheets

LIQUID DISCHARGE APPARATUS

CROSS-REFERENCE TO RELATED APPLICATION

This application claims priority from Japanese Patent Application No. 2011-262874, filed on Nov. 30, 2011, the entire subject matter of which is incorporated herein by reference.

TECHNICAL FIELD

Aspects of the present invention relate to a liquid discharge apparatus which discharges ink from a head to a recording medium, thereby forming an image.

BACKGROUND

An inkjet recording apparatus includes a head which has a plurality of liquid discharge holes formed on a nozzle surface provided at a lower surface and discharges ink to a recording medium e.g. a sheet, thereby performing printing. The inkjet recording apparatus includes a cap which, when not performing an image forming operation, seals the nozzle surface from a lower side to thus prevent a contact with an atmosphere, thereby preventing the ink in the liquid discharge holes from being dried.

When the ink is attached to the nozzle surface and the cap, it is desired to remove the attached ink. A known inkjet recording apparatus performs a wiping operation of wiping off the ink remaining on the nozzle surface and an upper surface of the cap. Specifically, this apparatus includes a wiper unit which slides horizontally in a conveyance direction of a recording medium between the nozzle surface and the cap, and the wiper unit includes a first upper blade which slides on the nozzle surface and a second lower blade which slides on the upper surface of the cap. During the wiping operation, the first blade contacts the nozzle surface and the second blade contacts the upper surface of the cap, thereby wiping off the ink remaining on the nozzle surface and the upper surface of the cap at one time.

SUMMARY

According to the above-described inkjet recording apparatus including the wiper unit, a mechanism to move the first blade is also used to move the second blade, so that the apparatus cost is reduced. However, the ink wiped by the first blade may flow down the second blade. Since the ink flowing down the second blade may not be wiped by the second blade, an effect of the wiping operation is deteriorated.

Accordingly, an aspect of the present invention provides a liquid discharge apparatus having a wiper unit in which ink wiped by a first blade does not flow down a second blade.

According to an illustrative embodiment of the present invention, there is provided a liquid discharge apparatus including a head, a liquid receiving part, a base, a first blade, a second blade and a moving mechanism. The head includes a nozzle surface having a plurality of liquid discharge holes formed thereon and being directed downward. The liquid receiving part includes a liquid receiving surface which is directed upward to oppose the nozzle surface and configured to receive liquid discharged from the liquid discharge holes. The first blade is attached to the base with a tip end thereof being directed upward to wipe the nozzle surface. The second blade is attached to the base with a tip end thereof being directed downward to wipe the liquid receiving surface. The moving mechanism is configured to move the base in a predetermined advancing direction between the head and the liquid receiving part. The base is provided with a prevention structure configured to prevent liquid wiped off by the first blade from flowing to the second blade.

According to the above configuration, the liquid wiped off by the first blade is prevented from flowing down the second blade by the prevention structure. Thereby, the liquid is securely wiped off by the second blade, so that an effect of the wiping operation can be improved.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, illustrative embodiments of the invention will be described with reference to the drawings. In the below descriptions, an upper and a lower indicate directions along a vertical direction. Also, ink is exemplified as a specific example of liquid.

Figure 1:
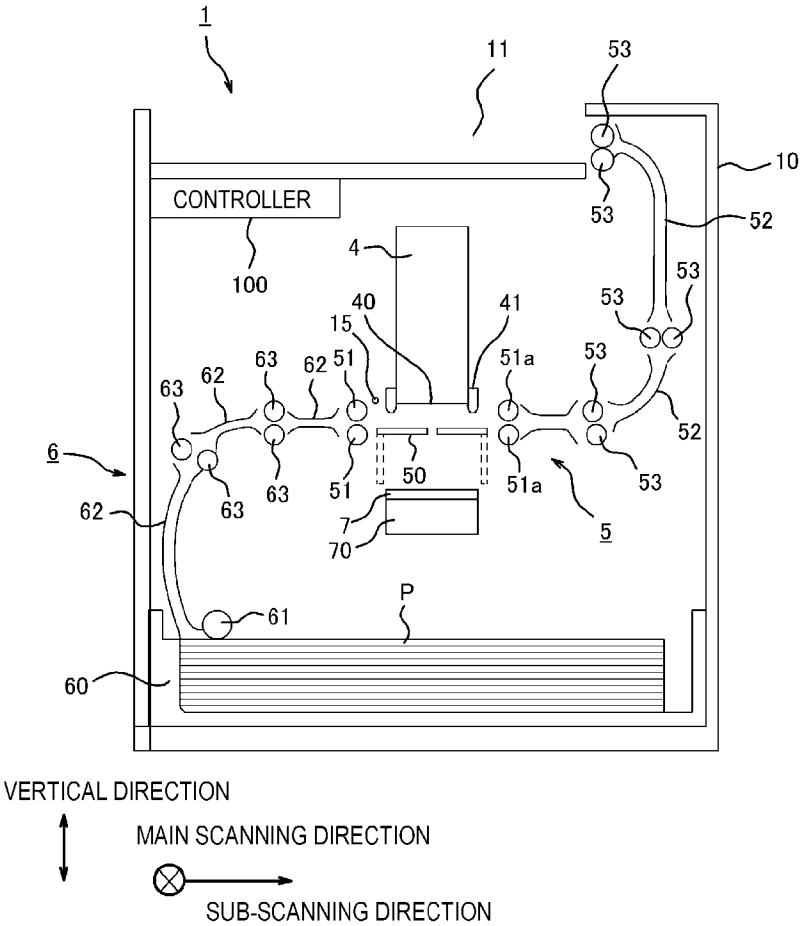
FIG. 1 is a schematic side view showing an overall configuration of an inkjet recording apparatus according to an illustrative embodiment of the invention.

As shown in FIG. 1, an inkjet recording apparatus 1 includes a housing 10 having a rectangular parallelepiped shape, and an upper part of a top plate of the housing 10 is provided with a sheet discharge part 11. The housing 10 includes therein a head 4 which discharges black ink downward onto a sheep P, a conveyance unit 5 which horizontally conveys the sheet P and then sends the same to the sheet discharge part 11, and a feeder unit 6 which feeds the sheet P. The housing 10 further includes a controller 100 which controls operations of respective mechanisms and electric circuits in the housing 10 at a position in an upper part thereof which does not interfere with the head 4.

The conveyance unit 5 is a mechanism which conveys the sheet P from the left to the right in FIG. 1. In the below descriptions, a direction along which the sheet P is conveyed in a printing region is referred to as a sub-scanning direction and a direction which is orthogonal to the sub-scanning direction in a horizontal plane is referred to as a main scanning direction.

The conveyance unit 5 includes a platen 50 and conveyance rollers 51, 51*a* arranged at both sides of the platen 50. The sheet P to which a conveyance force is applied by the conveyance roller 51 at an upstream side in a conveyance direction is conveyed with being supported on an upper surface of the platen 50. The sheet P having passed to the platen 50 is applied with a conveyance force by the conveyance roller 51*a* at a downstream side in the conveyance direction and is sent to the sheet discharge part 11 by a guide 52 and feeding rollers 53 positioned between the conveyance roller 51*a* and the sheet discharge part 11. A guide shaft 15 extending in the main scanning direction is provided between the conveyance roller 51 at the upstream side in the conveyance direction and the head 4. The guide shaft 15 guides sliding of a wiper unit 2 (described later). In the meantime, the guide shaft 15 may be provided between the conveyance roller 51*a* at the downstream side in the conveyance direction and the head 4.

The feeder unit 6 includes a sheet feeding tray 60 and a sheet feeding roller 61, and three guides 62 and feeding rollers 63 arranged between the sheet feeding roller 61 and the conveyance unit 5. The sheet feeding roller 61 picks up the uppermost sheet P in the sheet feeding tray 60 and conveys the same to an upstream side of the conveyance unit 5 by the guides 62 and the feeding rollers 63.

The head 4 is a line head having a rectangular parallelepiped shape and extending in the main scanning direction and a lower surface thereof is formed as a nozzle surface 40 having a plurality of liquid discharge holes through which ink is discharged. A periphery of a lower end portion of the head 4 is attached with an annular elastic member 41 which can be moved up and down. A liquid receiving member 7 is provided below the nozzle surface 40. When a printing operation is not performed on a sheet P, the elastic member 41 is lowered, so that a lower end thereof contacts the liquid receiving member 7. Although the head 4 can be moved up and down, the head is not moved up when a printing operation is performed, and the head is moved up when a wiping operation is performed.

Figure 2A:
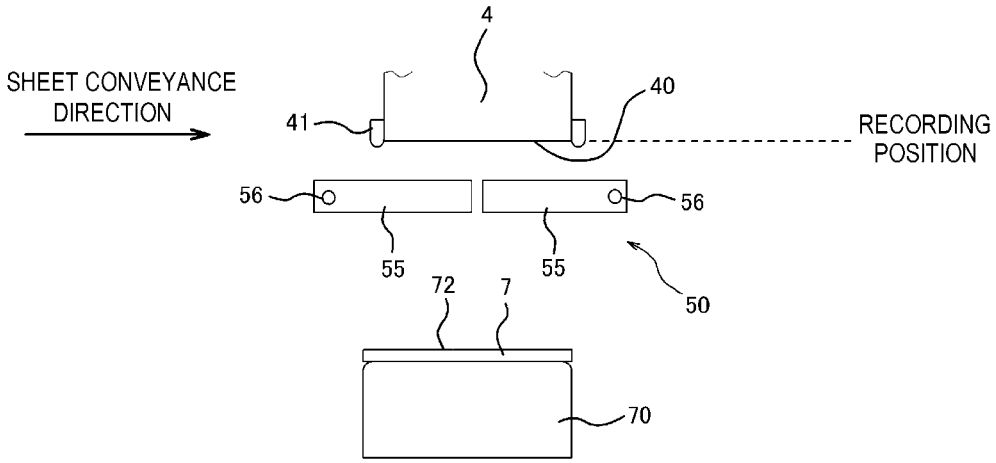
FIGS. 2A to 2C show moving operations of a platen and a liquid receiving member.
Figure 2B:
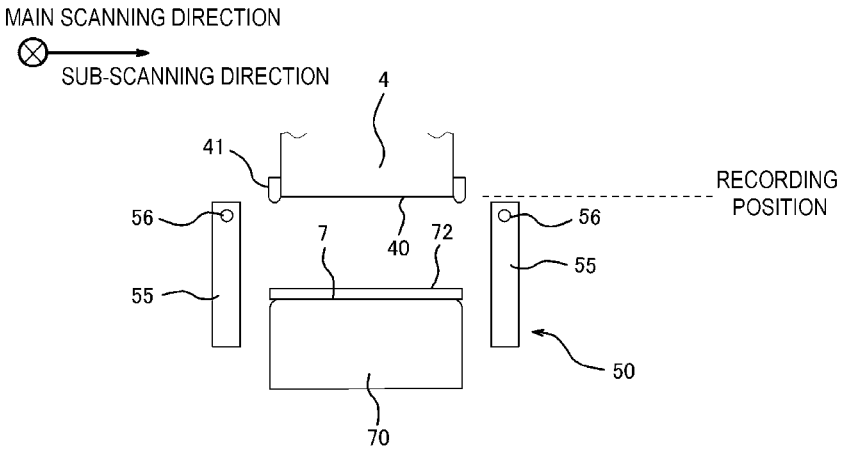
Figure 2C:
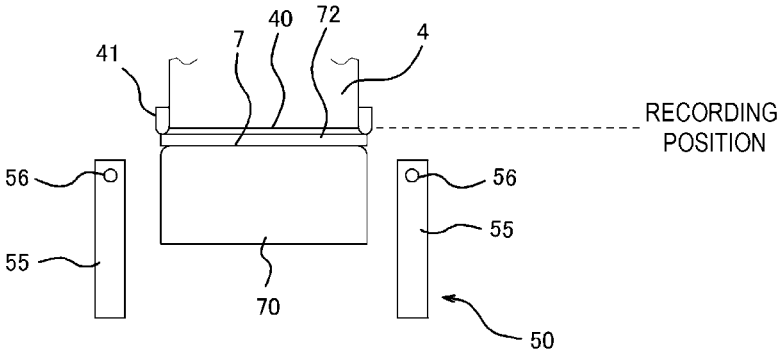

As shown in FIGS. 2A to 2C, the platen 50 includes a pair of door members 55, 55 made of resin. The door members 55, 55 are supported at one end portions thereof with shafts 56 parallel with the nozzle surface 40 of the head 4 and extending in the main scanning direction, so that the door members can rotate in opposite directions. The platen 50 is rotated between an opposing position (FIG. 2A) at which the door members 55, 55 are positioned in a horizontal plane and oppose the nozzle surface 40, and a non-opposing position (FIG. 2B) at which the door members 55, 55 are directed downward and do not oppose the nozzle surface 40. At the opposing position of the door members 55, 55, the sheet P passes to upper surfaces of the door members 55, 55, and, at this state, the ink is discharged from the head 4, so that a printing operation is performed on the sheet P.

An elevating member 70 having the liquid receiving member 7 on an upper surface thereof is provided below the platen 50. When performing a printing operation on the sheet P, the elevating member 70 is positioned below a conveyance path of the sheet P and is retracted from the conveyance path so that it does not interfere with the printing operation (FIG. 2A). As shown in FIG. 2B, at the non-opposing position of the door members 55, 55, a passage through which the elevating member 70 can pass is formed between the door members 55, 55. At a complete elevated state where the elevating member 70 completely elevates the liquid receiving member 7 (shown in FIG. 2C), the liquid receiving member 7 approaches the nozzle surface 40.

Figure 3:
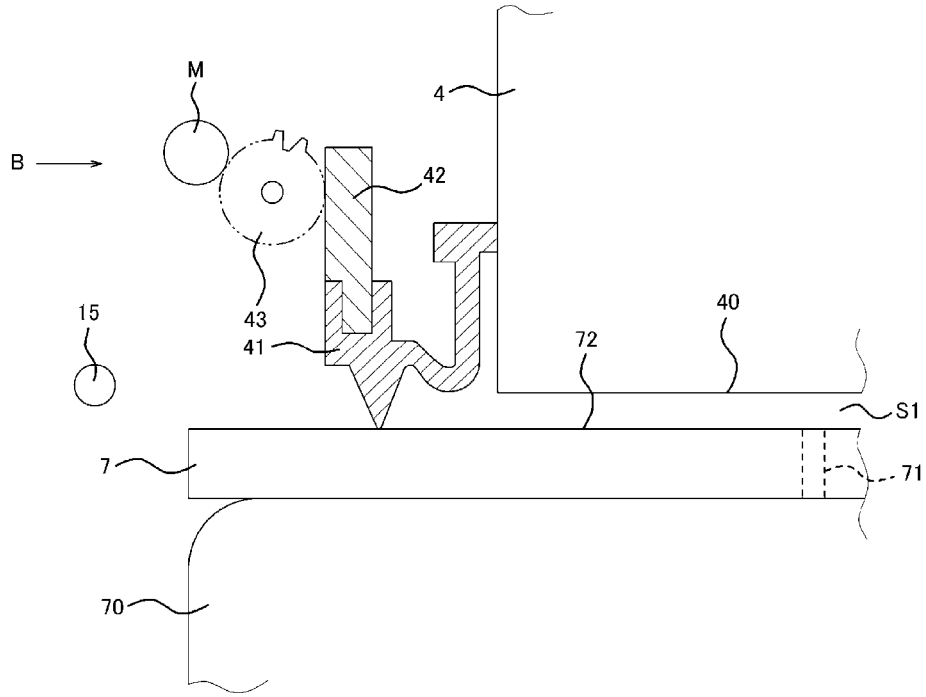
FIG. 3 is an enlarged view showing a surrounding portion of a head.

As shown in FIG. 3, the elastic member 41 is supported to a holder 42. The holder 42 is moved up and down relative to the head 4 via an intermediate gear 43 by a motor M. At the complete elevated state of the elevating member 70, the elastic member 41 and the holder 42 are moved down by the motor M and a lower end portion of the elastic member 41 is positioned below the nozzle surface 40 and contacts the liquid receiving member 7.

In a case where a printing operation is not performed for a long time, if the nozzle surface 40 is left exposed, the ink remaining on the nozzle surface 40 is dried. As a countermeasure, in such a case where a printing operation is not performed for a long time, the elastic member 41 is moved down to bring the lower end portion into contact with the liquid receiving member 7, so that a seal space S1 is formed between the nozzle surface 40 and the upper surface of the liquid receiving member 7. Thereby, the nozzle surface 40 is prevented from being exposed. That is, in this illustrative embodiment, the liquid receiving member 7 is used as a cap for preventing ink from being dried.

Also, after a predetermined number of times of printings or predetermined time of printing, the controller 100 performs a maintenance operation for keeping/restoring the ink discharge characteristic of the head 4. The maintenance operation is an operation of discharging the ink through the liquid discharge holes of the nozzle surface 40. The maintenance operation includes a purge operation in which a negative pressure is generated in the seal space S1 by a suction pump (not shown) to thus discharge remaining ink and foreign materials in the liquid discharge holes to a liquid receiving surface 72, which is an upper surface of the liquid receiving member 7. The liquid receiving member 7 is provided with a duct 71 through which the ink flows and the ink is collected into a waste liquid tank 76 (refer to FIG. 9) through the duct 71. The liquid receiving member 7 is made of glass or metal such as stainless steel which does not absorb liquid or absorbs little liquid.

In this operation, however, in most cases, all ink is not introduced into the duct 71 and ink remains on the liquid receiving surface 72. In this case, a medium of the remaining ink is evaporated, so that the ink becomes thickening ink. At this state, when the liquid receiving member 7 seals the nozzle surface 40, the thickening ink absorbs water from the air in the seal space S1. That is, the thickening ink serves as a drying agent. By this phenomenon, when the water is absorbed from the ink remaining on the nozzle surface 40, a discharge defect of the ink from the head 4 may be caused.

Figure 4:
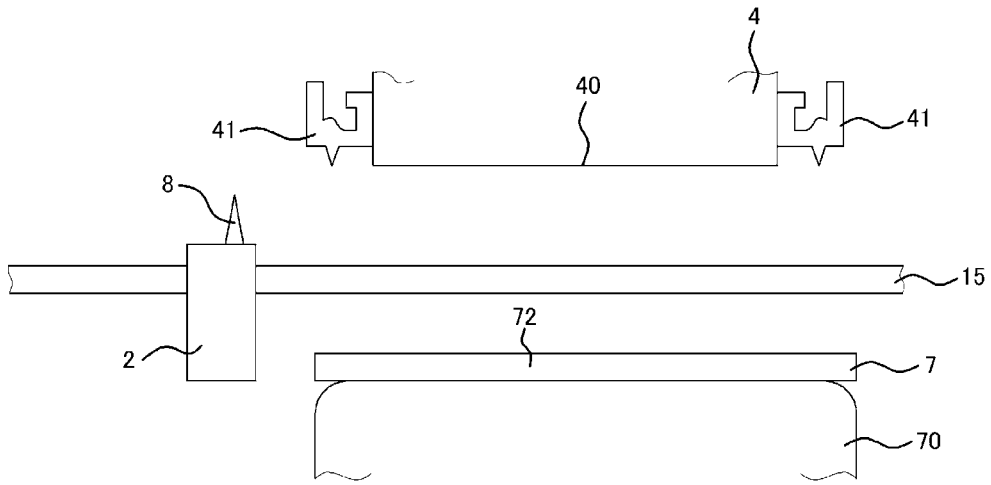
FIG. 4 shows the surrounding portion of the head shown in FIG. 3, which is seen from an arrow B direction.

In order to prevent the defect, the inkjet recording apparatus 1 of this illustrative embodiment is provided at a side of the head 4 with a wiper unit 2 which wipes off the ink remaining on the nozzle surface 40 and also the ink remaining on the liquid receiving surface 72, as shown in FIG. 4. In the below descriptions, a predetermined advancing direction along which the wiper unit 2 is advanced to wipe off the ink remaining on the nozzle surface 40 and the liquid receiving surface 72 is referred to as the front. Also, an operation of wiping off the ink is referred to as a wiping operation.

(Overall Configuration of Wiper Unit)

Figure 5:
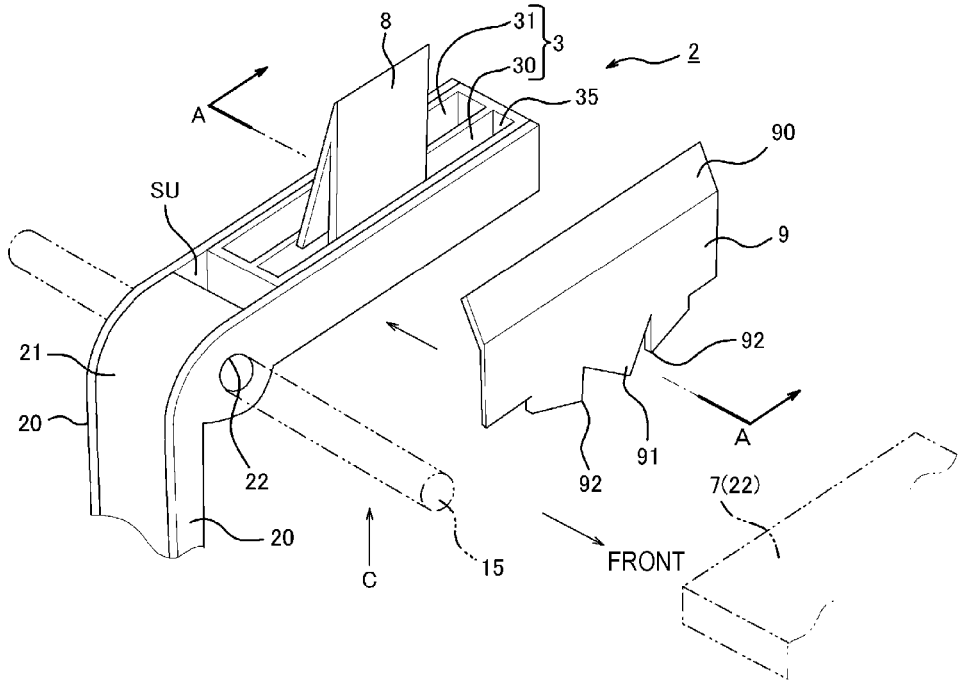
FIG. 5 is a perspective view of a wiper unit.

As shown in the perspective view of FIG. 5, the wiper unit 2 includes a support holder 20 configured by a pair of metal plates spaced from each other, a base 3 made of resin which is provided at a tip end portion of the support holder 20 and opposes the nozzle surface 40 of the head 4, and an engaging piece 21 which is positioned at a base end portion side of the support holder 20 with respect to the base 3. The support holder 20 and the engaging piece 21 are provided with an engaging part 22 into which the guide shaft 15 is engaged, and a gap SU is formed between the base 3 and the engaging part 22. In the meantime, the engaging piece 21 is connected at a lower end portion thereof to a driving mechanism having a ball screw, for example, and is applied with a moving force in a direction along the guide shaft 15. That is, the moving mechanism which advances the wiper unit 2 is configured by the driving mechanism and the guide shaft 15.

Figure 6:
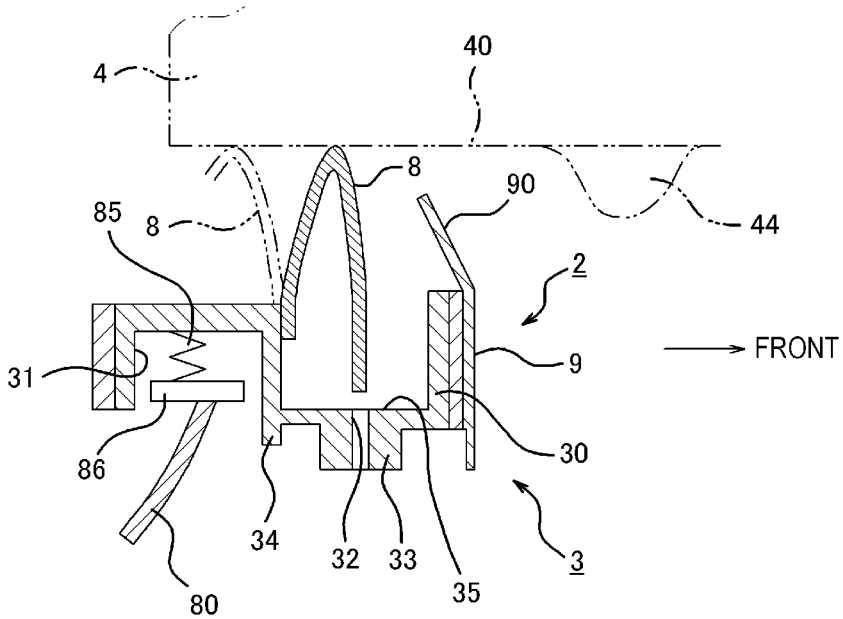
FIG. 6 is a sectional view of the wiper unit shown in FIG. 5, which is taken along a plane including a line A-A.

As shown in the sectional view of FIG. 6, the base 3 has a first receiving chamber 30 has an opening upper part which is opened upwardly and a second receiving chamber 31 which is provided at the rear of the first receiving chamber 30 and has an opening lower part which is opened downwardly. A lower surface of the first receiving chamber 30 is formed with a through-hole 32 and a cylindrical part 32 protruding downward so as to surround the through-hole 32. An internal space of the cylindrical part 32 extends continuously from the through-hole 32. In the first receiving chamber 30, a first blade 8 is attached to be directed upward. In the second receiving chamber 31, a second blade 80 is attached to be directed downward. That is, the first blade 8 is positioned more forward than the second blade 80 in the advancing direction of the wiper unit 2, and the through-hole 32 and the cylindrical part 33 are also positioned at more forward than the second blade 80.

An upper end portion of the first blade 8 is moved with contacting the nozzle surface 40 of the head 4, thereby wiping off the ink remaining on the nozzle surface 40. A lower end portion of the second blade 80 is moved with contacting the liquid receiving surface 72, thereby wiping off the ink remaining on the liquid receiving surface 72. Both the blades 8, 80 are made of a flexible material such as rubber such that the nozzle surface 40 of the head 4 and the liquid receiving surface 72 are not damaged.

In the first receiving chamber 30, a liquid receiving space 35 is formed which receives the ink wiped off by the first blade 8. A front end of the opening part of the first receiving chamber 30 is positioned more forward than a front face of the first blade 8 and a rear end of the opening part is positioned more rearward than the front face of the first blade 8. Thereby, ink on the nozzle surface 40, which has been wiped off by the first blade 8, is securely received in the liquid receiving space 35. Then, the received ink passes through the through-hole 32 and the inside of the cylindrical part 33 and is then discharged to the liquid receiving surface 72 of the liquid receiving member 7.

Thereby, ink is prevented from flowing to the second blade 80. That is, the through-hole 32 and the cylindrical part 33, which are positioned more forward than the second blade 80 in the advancing direction of the wiper unit 2, and the liquid receiving space 35 configure the structure of preventing ink from flowing to the second blade 80. As described above, since the through-hole 32 and the cylindrical part 33 are positioned more forward than the second blade 80, ink on the liquid receiving member 7 is securely wiped off upon the wiping operation, so that it is possible to improve the effect of the wiping operation.

Also, the through-hole 32 and the cylindrical part 33 oppose a center portion of the liquid receiving member 7 in a width direction, which is orthogonal to the advancing direction of the wiper unit 2. Therefore, the ink having passed through the through-hole 32 and the cylindrical part 33 comes down to the center portion of the liquid receiving member 7 in the width direction. If the ink comes down to an end portion of the liquid receiving surface 72 in the width direction, the ink is not surely received on the liquid receiving surface 72, so that the ink may flow down from the liquid receiving surface 72. However, since the ink comes down to the center portion of the liquid receiving surface 72 in the width direction, there is less concern about this problem.

A thin member 9 having a sheet shape and extending in the upper-lower direction is attached on a front wall of the first receiving chamber 30. The thin member 9 has an inclined part at an upper end portion thereof, which is inclined rearward as proceeding upward. An upper end of the inclined part 90 is positioned above the upper surface of the first receiving chamber 30 and is positioned below the tip end of the first blade 8. That is, the inclined part 90 is not directly contacted to the nozzle surface 40 but is close to the nozzle surface. A lower end of the thin member 9 is positioned below the lower end of the cylindrical part 33.

As shown in FIG. 6, an ink droplet 44 attached to the nozzle surface 40 is wiped off not only by the first blade 8 but also by the upper end of the inclined part 90 of the thin member 9. Thereby, it is possible to wipe off more ink, compared to a configuration where the ink is wiped off only by the first blade 8.

The ink flows to the lower end of the thin member 9 along the thin member 9. Since the lower end of the thin member 9 is positioned below the lower end of the cylindrical part 33, the ink flowing down the thin member 9 is prevented from being splashed on the liquid receive surface 72. Thereby, the effect of surely dropping the ink onto the liquid receiving surface 72 is improved.

As shown in FIG. 5, the lower end of the thin member 9 is provided with a main apex part 91, which opposes the center portion of the liquid receiving member 7 in the width direction orthogonal to the advancing direction of the wiper unit 2, and two sub-apex parts 92, 92 which are positioned at both sides of the main apex part 91 in the width direction of the liquid receiving member 7. Since the main apex part 91 opposes the center portion of the liquid receiving member 7, the ink flowing down the main apex part 91 is surely received onto the liquid receiving surface 72. Also, the ink wiped off by the thin member 9 is widely dropped from the main apex part 91 and the sub-apex parts 92 over the width direction of the liquid receiving member 7. Therefore, it is possible to prevent the concern that the ink is intensively dropped onto one position of the liquid receiving surface 72 and the ink is thus excessively spread or scattered.

As shown in FIG. 6, the upper end of the second blade 80 is attached to an intermediate plate 86 which is provided to move up and down in the second receiving chamber 31, and a spring 86 is provided between the intermediate plate 86 and an upper wall of the second receiving chamber 31. By the spring 85, the second blade 80 is pressed to the upper surface of the liquid receiving member 7. That is, the dedicated member for pressing the second blade 80 to the upper surface of the liquid receiving member 7 is provided, so that it is possible to shorten the second blade 80, compared to a configuration where the second blade 80 is pressed to the upper surface of the liquid receiving member 7 only by elasticity of the second blade 80 itself. Thereby, it is possible to make the entire wiper unit 2 small. Also, the pressing force is increased and the pressing state becomes stable, compared to the configuration where the second blade 80 is pressed to the upper surface of the liquid receiving member 7 by the elasticity of the second blade 80 itself. Also, since the second blade 80 can move up and down by the spring 85, it is possible to absorb the vibration which is received from the liquid receiving surface 72 upon the wiping operation.

Figure 7A:
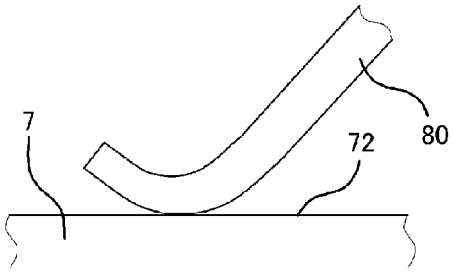
FIGS. 7A and 7B show a tip end portion of a second blade.
Figure 7B:
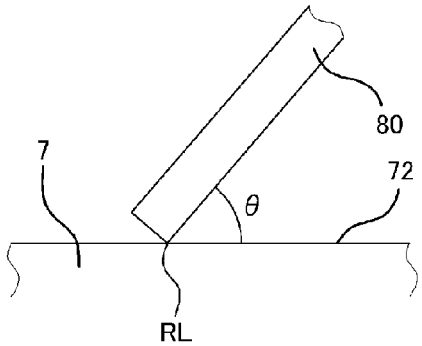

In the meantime, as shown in FIG. 7A, if the second blade 80 is bent when contacting the upper surface of the liquid receiving member 7, the effect of wiping off the liquid is decreased. Therefore, as shown in FIG. 7B, it is necessary to press the second blade 80 such that a lower edge line RL of the second blade 80 contacts the upper surface of the liquid receiving member 7. Also, it is advantageous that a contact angle θ between the second blade 80 and the upper surface of the liquid receiving member 7 is small. Also, the nozzle surface 40 is directed downward, and thus, ink is dropped therefrom. On the other hand, the upper surface of the liquid receiving member 7 is directed upward, and thus, ink is apt to remain on the upper surface. Therefore, it is advantageous that the second blade 80 contact the upper surface of the liquid receiving member 7 to thus wipe off the ink with the pressing force larger than the force with which the first blade 8 contacts the nozzle surface 40. Hence, it is advantageous to press the second blade 80 by the spring 85.

Figure 8:
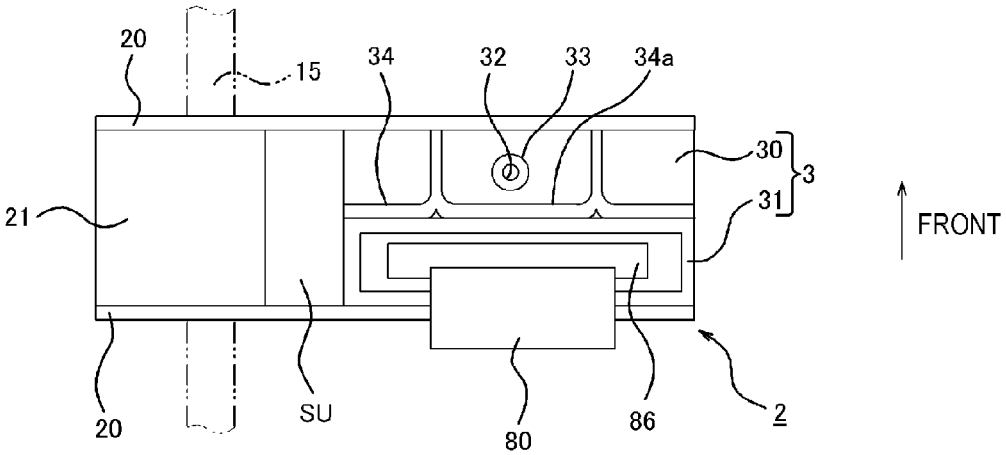
FIG. 8 is a bottom view of the wiper unit of FIG. 5, which is seen from a C direction.

As shown in the bottom view of FIG. 8, a bottom side of the first receiving chamber 30 is provided with a rib 34 so as to surround the periphery of the cylindrical part 33 and the through-hole 32. A rear wall part 34*a* of the rib 34 is provided between the through-hole 32 and the second blade 80. Although the ink discharged from the cylindrical part 33 is dropped onto the liquid receiving surface 72, a part of the ink may flow along the bottom side of the first receiving chamber 30 from a side portion of the cylindrical part 33. However, the part of the ink is blocked by the rib 34 and is dropped onto the upper surface of the liquid receiving member 7 along the rib 34. Thereby, it is possible to further prevent the ink from flowing down the second blade 80.

Also, the rib 34 surrounds the periphery of the cylindrical part 33 and the through-hole 32, so that the ink flowing along the bottom side of the first receiving chamber 30 from the side portion of the cylindrical part 33 is prevented from flowing to the outside of the rib 34. In particular, the ink being directed toward the second blade 80 is blocked by the rear wall part 34*a*. That is, the ink is surely dropped onto the liquid receiving surface 72 and can be further prevented from flowing to the second blade 80.

Also, as described above, the gap SU is formed between the base 3 of the wiper unit 2 and the engaging part 22. The ink flowing along the bottom side of the first receiving chamber 30 from the side portion of the cylindrical part 33 is blocked by the rib 34. Further, even though the ink overflows the rib 34, the ink is prevented from flowing to the engaging part 22 by the gap SU. Thereby, the ink surely flows toward the liquid receiving surface 72.

(Wiping Operation)

FIGS. 9A to 9C and 10A to 10C show the wiping operation of the wiper unit 2 and a configuration of a surrounding portion of the liquid receiving member 7, in which the head 4 shown in FIG. 1 is seen from the sub-scanning direction. For convenience of illustration, the support holder 20, the thin member 9 and the fitting piece 21 are not shown. The wiping operation is performed according to a program stored in the controller 100.

At a front side of the liquid receiving member 7 and the elevating member 70, a waste ink container 75 is provided. The waste ink container 75 receives ink wiped off by the second blade 80 and pushed from the liquid receiving member 7. The ink in the waste ink container 75 is collected to the waste liquid tank 76 by a pump P. The waste liquid tank 76 is the same as a tank which collects the ink upon the purge operation.

Also, an ink absorbing member 77 is provided at a rear side of the liquid receiving member 7, and the ink absorbing member 77 is covered with a mesh-type lid plate 78. As described below, the second blade 80 which wipes the liquid receiving surface 72 opposes the lid plate 78 before the wiping operation starts.

The waste ink container 75 and the ink absorbing member 77 are moved up together with the liquid receiving member 7.

In the meantime, during the wiping operation, the wiper unit 2 wipes off the ink remaining on the nozzle surface 40 of the head 4 by the first blade 8, returns to an original position of the wiping operation, and then, again advances and wipes off the ink remaining on the liquid receiving surface 72 by the second blade 80.

That is, the wiper unit does not wipe off the ink remaining on the nozzle surface 40 and the liquid receiving surface 72 at one time by the first blade 8 and the second blade 80. The reasons are as follows.

(1) Since the nozzle surface 40 and the liquid receiving surface 72 have different coefficients of friction, the appropriate advancing speeds of the blades wiping off the ink remaining on the nozzle surface 40 and the liquid receiving surface 72 are different. Specifically, the appropriate speed of the second blade 80 wiping off the ink remaining on the liquid receiving surface 72 is higher than that of the first blade 8 wiping off the ink remaining on the nozzle surface 40. If the speed of the second blade 80 wiping off the ink remaining on the liquid receiving surface 72 is slower, the ink is apt to spread on the liquid receiving surface 72, so that the effect of the wiping operation is deteriorated.

(2) When the ink remaining on the nozzle surface 40 and the liquid receiving surface 72 is wiped off at one time, the advancing loads of both blades 8, 80 are increased by friction between the nozzle surface 40 and the liquid receiving surface 72.

Figure 9A:
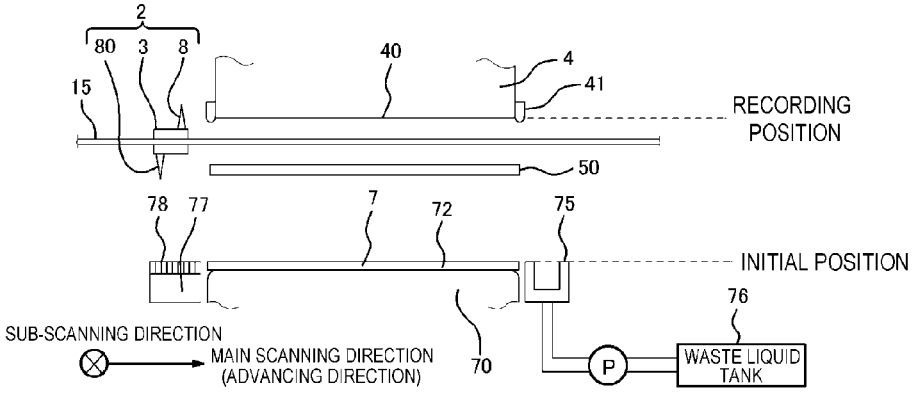
FIGS. 9A to 9C show a wiping operation of the wiper unit and a configuration of a surrounding portion of a liquid receiving member.

When the purge operation by the suction pump ends, the elevating member 70 and the liquid receiving member 7 are moved down, as shown in FIG. 9A. A space for operating the wiper unit 2 is formed between the nozzle surface 40 of the head 4 and the liquid receiving surface 72. At this time, a height position of the liquid receiving surface 72 is set as an initial position. A height of the nozzle surface 40 is a recording position when a printing operation is performed on a recording medium, and the nozzle surface 40 is located at a lower position than the tip end of the first blade 8. The elastic member 41 is moved up and the lower end portion thereof is positioned in the same plane as the nozzle surface 40 or at a height higher than the nozzle surface 40. Also, before the wiping operation, the wiper unit 2 is deviated from between the nozzle surface 40 and the liquid receiving member 7.

Figure 9B:
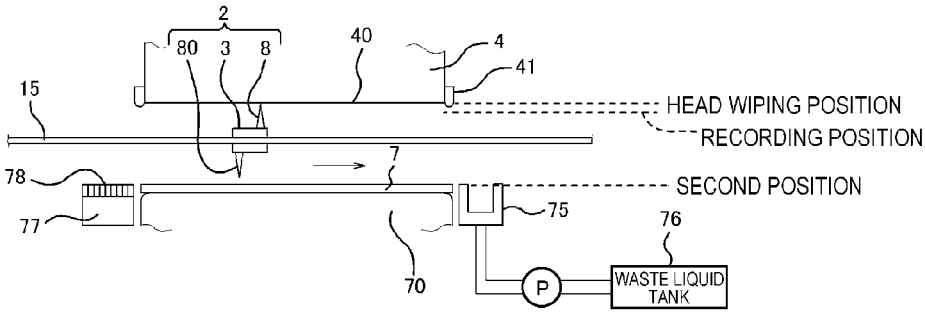

Then, as shown in FIG. 9B, the head 4 is slightly moved up and reaches a head wiping position. The head wiping position is a height position at which the first blade 9 can wipe off the ink remaining on the nozzle surface 40. Also, the liquid receiving member 7 and the elevating member 70 are slightly moved up from the initial position, so that the liquid receiving surface 72 reaches a second position. At the second position, the liquid receiving surface 72 is below the lower end of the second blade 80.

Then, the wiper unit 2 advances such that the first blade 8 wipes off the ink remaining on the nozzle surface 40. During this wiping, the second blade 80 does not contact the liquid receiving surface 72. As described above, the ink wiped off by the first blade 8 passes through the through-hole 32 and the cylindrical part 33 and is dropped onto the liquid receiving surface 72 at the front of the second blade 80. The liquid receiving surface 72 is located at the second position elevated from the initial position, so that the dropped ink is reduced or prevented from being scattered.

Figure 9C:
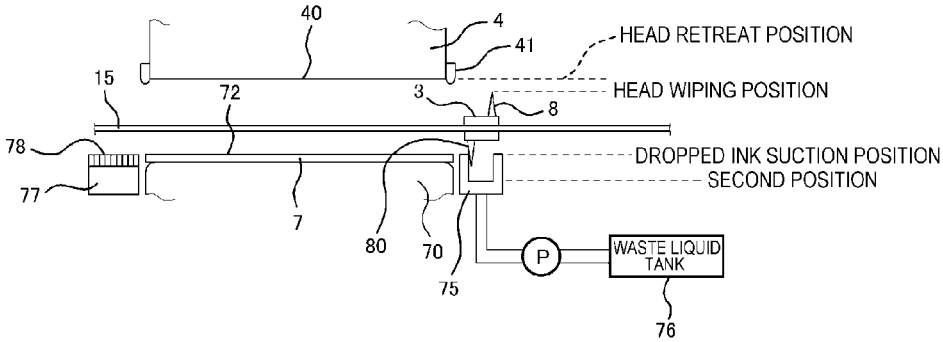

When the first blade 8 wipes the nozzle surface 40 entirely, the head 4 is further moved up from the head wiping position, as shown in FIG. 9C, so that the nozzle surface 40 reaches a head retreat position. At the head retreat position, the height position of the nozzle surface 40 is higher than the tip end of the first blade 8. The wiper unit 2 stops after the nozzle surface 40 and is positioned above the waste ink container 75. The elevation member 70 is moved up, so that the liquid receiving surface 72 and the upper surface of the waste ink container 75 reaches a dropped ink suction position from the second position, and the waste ink container 75 is positioned just below the cylindrical part 33 of the wiper unit 2. The pump P is used to suction the ink, which remains in the liquid receiving space 35 of the base 3 and can be dropped from the cylindrical part 33, into the waste liquid tank 76. Since the ink has a viscosity, the ink may remain in the liquid receiving space 35 even after the wiper unit 2 has passed the nozzle surface 40. Considering a case where such remaining ink is dropped from the base 3, the ink is received in the waste ink container 75.

Figure 10A:
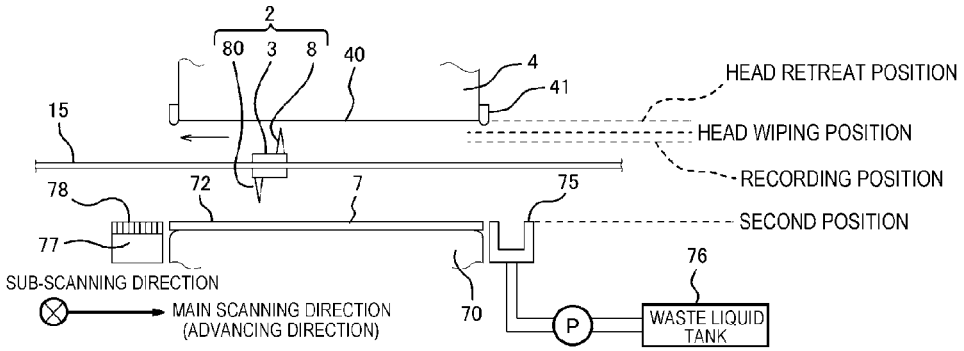
FIGS. 10A to 10C show a wiping operation of the wiper unit and a configuration of a surrounding portion of the liquid receiving member.

Then, as shown in FIG. 10A, the elevating member 7 is moved down, so that the liquid receiving surface 72 and the upper surface of the waste ink container 75 reach the second position from the dropped ink suction position. Thereby, a return passage of the wiper unit 2 is formed and the wiper unit 2 is returned along the guide shaft 15. While the wiper unit 2 is returned, the first blade 8 is separated from the nozzle surface 40 and the second blade 80 is separated from the liquid receiving surface 72, so that the blades do not wipe off the ink.

Figure 10B:
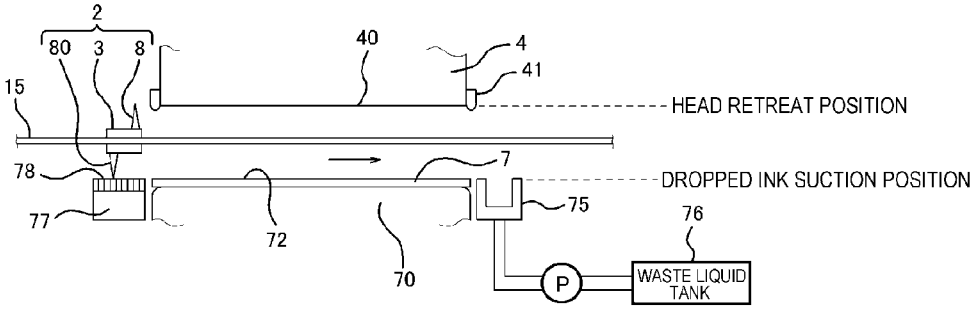

At a state where the wiper unit 2 is returned completely, as shown in FIG. 10B, the elevation member 70 is moved up, so that the liquid receiving surface 72 and the upper surface of the lid plate 78 reach the dropped ink suction position from the second position. The second blade 80 of the wiper unit 2 contacts the lid plate 78, so that the tip end portion thereof is cleaned by the ink absorbing member 77. If the ink is attached to the tip end portion of the second blade 80, the ink on the upper surface of the liquid receiving member 7 cannot be sufficiently wiped off. Therefore, the tip end portion of the second blade 80 is cleaned in advance.

After the cleaning is completed, the liquid receiving member 7 and the lid plate 78 are moved down by a predetermined distance from the state shown in FIG. 10B. After the wiper unit 2 advances by a predetermined distance, the wiper unit 2 stops. The stopped position is outside an area where the ink droplet 44 can be dropped from the nozzle surface 40 (refer to FIG. 10C). That is, the second blade 80 starts the ink wiping from the site where the ink cannot dropped, so as to prevent the ink from remaining without being completely wiped off.

Figure 10C:
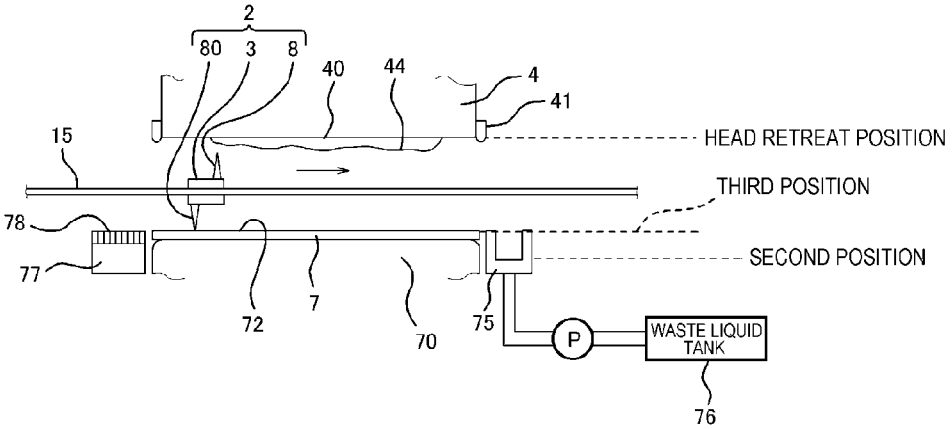

The elevating member 70 is again moved up, so that the liquid receiving surface 72 reaches a third position higher than the second position, as shown in FIG. 10C. The third position is a height position at which the tip end of the second blade 80 contacts the liquid receiving surface 72 at the state shown in FIG. 7B. The height may be substantially same as the dropped ink suction position. Then, the wiper unit 2 is again advanced to wipe off the ink remaining on the liquid receiving surface 72. When the second blade 80 passes the liquid receiving surface 72, the ink wiped off by the second blade 80 is received in the waste ink container 75 and flows into the waste liquid tank 76. Thereby, the wiping operation ends.

After the wiping operation ends, the pump P is used to suction the ink attached to the second blade 80 into the waste liquid tank 76, as shown in FIG. 9C. Then, the liquid receiving member 7 and the waste ink container 75 are lowered to retreat from the wiper unit 2, and the head 4 is lowered until the nozzle surface 40 reaches the height position of the recording position.

By the configuration and operation of the wiper unit 2, it is possible to effectively reduce or prevent the ink on the nozzle surface 40 wiped off by the first blade 8 from flowing to the second blade 80.

While the present invention has been shown and described with reference to certain illustrative embodiments thereof, it will be understood by those skilled in the art that various changes in form and details may be made therein without departing from the spirit and scope of the invention as defined by the appended claims.

In the above illustrative embodiment, the first blade 8 is provided between the front end of the opening part of the first receiving chamber 30 and the rear end thereof. However, instead of this configuration, the first blade 8 may be provided at the rear end of the opening part, and the wiped off ink may be received in the liquid receiving space 35, as shown with the dotted-dashed line in FIG. 6.

Also, in the inkjet recording apparatus 1 of the above illustrative embodiment, the liquid receiving member 7 is also used as a cap for sealing the nozzle surface 40. However, instead of this configuration, the cap may be used as the liquid receiving member. Also, the liquid receiving member 7 and the cap may be separately provided.

Also, in the inkjet recording apparatus 1 of the above illustrative embodiment, the ink is discharged onto the liquid receiving surface 72 upon the purge operation. However, instead of this configuration or in addition to this configuration, a flushing operation of driving the head 4 based on flushing data different from the image data and thus forcibly discharging the ink through a part or all of the liquid discharge holes may be performed, and the ink may be discharged onto the liquid receiving surface 72 upon the flushing operation.

In the above illustrative embodiment, the inkjet recording apparatus 1 is a monochrome type recording apparatus which uses only black ink. However, the inventive concept of the present invention can be also applied to a recording apparatus which uses three-color inks of cyan, yellow and magenta, like a general color printer.

What is claimed is:

1. A liquid discharge apparatus comprising:

a head including a nozzle surface having a plurality of liquid discharge holes formed thereon, the nozzle surface being directed downward;

a liquid receiving part including a liquid receiving surface, the liquid receiving surface being directed upward to oppose the nozzle surface and configured to receive liquid discharged from the liquid discharge holes;

a base;

a first blade attached to the base with a tip end thereof being directed upward to wipe the nozzle surface;

a second blade attached to the base with a tip end thereof being directed downward to wipe the liquid receiving surface; and a moving mechanism configured to move the base in a predetermined advancing direction between the head and the liquid receiving part, wherein the base is provided with a prevention structure configured to prevent liquid wiped off by the first blade from flowing to the second blade, and wherein the prevention structure includes:

a liquid receiving space formed in the base and having an opening part which is opened upward; and a through-hole penetrating the base from a bottom part of the liquid receiving space to a lower surface of the base, and through which liquid received in the liquid receiving space is dropped.

2. The liquid discharge apparatus according to claim 1, wherein a front end of the opening part of the liquid receiving space in the advancing direction is positioned more forward than a front face of the first blade in the advancing direction, and wherein a rear end of the opening part of the liquid receiving space in the advancing direction is positioned more rearward than the front face of the first blade in the advancing direction or at a same position as the front face of the first blade in the advancing direction.

3. The liquid discharge apparatus according to claim 1, wherein the prevention structure includes a cylindrical part which protrudes downward from the lower surface of the base and which has an internal space extending continuously from the through-hole.

4. The liquid discharge apparatus according to claim 1, wherein the through-hole is positioned more forward than the second blade in the advancing direction.

5. The liquid discharge apparatus according to claim 1, wherein the prevention structure includes a rib which is formed on the lower surface of the base, and wherein at least a part of the rib is formed between the through-hole and the second blade.

6. The liquid discharge apparatus according to claim 5, wherein the rib is formed to surround the through-hole.

7. The liquid discharge apparatus according to claim 1, wherein the prevention structure includes a thin member which extends vertically and is attached to a front end of the base in the advancing direction, and wherein the thin member includes an upper end which is positioned above an upper surface of the base and below the tip end of the first blade, and a lower end which is positioned below a lower surface of the base.

8. The liquid discharge apparatus according to claim 7, wherein the lower end of the thin member is formed with a main apex part which is directed downward, and wherein the through-hole and the main apex part oppose a center portion of the liquid receiving surface in a width direction thereof orthogonal to the advancing direction.

9. The liquid discharge apparatus according to claim 8, wherein the lower end of the thin member is further formed with one or more sub-apex parts which are directed downward and are lined with the main apex part in the width direction.

10. The liquid discharge apparatus according to claim 1, further comprising:

a guide member extending in the advancing direction; and a support holder supporting the base and configured to slide while being guided by the guide member, wherein the support holder includes an engaging part which is engaged with the guide member, and wherein the support holder supports the base such that a gap is formed between the engaging part and the base.

11. The liquid discharge apparatus according to claim 1, wherein the base is formed with a second blade receiving space which has an opening part opened downward and receives a base end portion of the second blade, and wherein the second blade receiving space is provided with a spring member configured to urge the second blade toward the liquid receiving surface.

12. A liquid discharge apparatus comprising:

a head including a nozzle surface having a plurality of liquid discharge holes formed thereon, the nozzle surface being directed downward;

a liquid receiving part including a liquid receiving surface, the liquid receiving surface being directed upward to oppose the nozzle surface and configured to receive liquid discharged from the liquid discharge holes;

a base;

a first blade attached to the base with a tip end thereof being directed upward to wipe the nozzle surface;

a second blade attached to the base with a tip end thereof being directed downward to wipe the liquid receiving surface; and a moving mechanism configured to move the base in a predetermined advancing direction between the head and the liquid receiving part when the first blade wipes the nozzle surface, wherein the first blade is positioned more forward than the second blade in the advancing direction.

13. The liquid discharge apparatus according to claim 12, further comprising:

a rib formed on a lower surface of the base, wherein at least a part of the rib is formed between the first blade and the second blade in the advancing direction.

14. A liquid discharge apparatus comprising:

a head including a nozzle surface having a plurality of liquid discharge holes formed thereon, the nozzle surface being directed downward;

a liquid receiving part including a liquid receiving surface, the liquid receiving surface being directed upward to oppose the nozzle surface and configured to receive liquid discharged from the liquid discharge holes;

a base;

a first blade attached to the base with a tip end thereof being directed upward to wipe the nozzle surface;

a second blade attached to the base with a tip end thereof being directed downward to wipe the liquid receiving surface; and a moving mechanism configured to move the base in a predetermined advancing direction between the head and the liquid receiving part, wherein the base is provided with a prevention structure configured to prevent liquid wiped off by the first blade from flowing to the second blade, wherein the prevention structure includes a thin member which extends vertically and is attached to a front end of the base in the advancing direction, and wherein the thin member includes an upper end which is positioned above an upper surface of the base and below the tip end of the first blade, and a lower end which is positioned below a lower surface of the base.

15. A liquid discharge apparatus comprising:

a head including a nozzle surface having a plurality of liquid discharge holes formed thereon, the nozzle surface being directed downward;

a liquid receiving part including a liquid receiving surface, the liquid receiving surface being directed upward to oppose the nozzle surface and configured to receive liquid discharged from the liquid discharge holes;

a base;

a first blade attached to the base with a tip end thereof being directed upward to wipe the nozzle surface;

a second blade attached to the base with a tip end thereof being directed downward to wipe the liquid receiving surface;

a rib formed on a lower surface of the base; and a moving mechanism configured to move the base in a predetermined advancing direction between the head and the liquid receiving part, wherein the first blade is positioned more forward than the second blade in the advancing direction, and wherein at least a part of the rib is formed between the first blade and the second blade in the advancing direction.

* * * * *